US005610692A

United States Patent [19]

Trask et al.

[11] Patent Number: 5,610,692

[45] Date of Patent: Mar. 11, 1997

[54] TONER HOPPER LOCKOUT MECHANISM

[75] Inventors: Jeffrey L. Trask, Boise, Id.; Hiroyuki Honda; Kenji Sato, both of Hachioji, Japan

[73] Assignee: Hewlett-Packard Company, Palo Alto, Calif.

[21] Appl. No.: 306,049

[22] Filed: Sep. 14, 1994

[51] Int. Cl.[6] ..... G03G 15/08

[52] U.S. Cl. ..... 399/27; 399/262

[58] Field of Search ..... 355/205–207, 355/245, 260, 326 R, 327; 222/DIG. 1

[56] References Cited

U.S. PATENT DOCUMENTS

| | | | |
|---|---|---|---|
| 5,184,181 | 2/1993 | Kurando et al. | 355/260 |
| 5,289,243 | 2/1994 | Sakamoto | 355/260 |
| 5,313,993 | 5/1994 | Corby et al. | 355/260 X |
| 5,392,102 | 2/1995 | Toyoizumi et al. | 355/245 |
| 5,430,531 | 7/1995 | Kamiya | 355/260 |

FOREIGN PATENT DOCUMENTS

| | | |
|---|---|---|
| 61-170760 | 8/1986 | Japan . |
| 63-220287 | 9/1988 | Japan . |
| 1142764 | 6/1989 | Japan . |
| 4-066982 | 3/1992 | Japan . |
| 6250522 | 9/1994 | Japan . |

*Primary Examiner*—Robert Beatty

[57] ABSTRACT

A lockout mechanism for preventing an operator from filling a toner hopper in an electrographic printing device until the hopper is at least empty enough to accept the entire contents of a toner cartridge. An interlock mechanism takes advantage of the already existing selector shaft to selectively de-activate lockout members in response to a low toner level transducer. Each hopper is provided with a lockout member which is pivotable between a locked out position and a refill position. The locked out position has the lockout members interfering with a connection between toner cartridges and the top of toner hoppers. The lockout members are held in their locked out positions by cam follower members, which are slidable between an upward locked out position and a downward refill position. The slider member interacts with the cam follower members, via follower pins and notches, to lock the cam follower members in their upwards position or to allow them to move down against the selector cams.

5 Claims, 12 Drawing Sheets

TONER HOPPER LOCKOUT MECHANISM

BACKGROUND OF THE INVENTION

1. Technical Field

This invention generally relates to toner supply mechanisms for laser printers and copiers. More particularly, this invention relates to a lockout device for a toner hopper which prevents an operator from over-filling a toner hopper.

2. Background Art

The increase in the number of abilities and features of laser printers has resulted in tremendously complex electronic and mechanical designs. With more complex designs come more potential problems and more possibilities for operator error. For instance, with the advent of color copying and color laser printing, it is possible for the operator to use the wrong color of toner to refill one of the toner hoppers, and unless the manufacturer anticipates this and provides some type of safe guard mechanism to prevent it, this can have disastrous consequences. Depending upon the sophistication of the operator, or more importantly how broad of a market a particular product is targeted for, the number of safe guard devices necessary to insure reliable operation is almost directly proportional to the number of features the product has.

Typical of this phenomenon is the set of electrical and mechanical checks or interlocks built into the toner supply system of the KONICA color laser printer engine. The KONICA color laser engine has as its first check level, a piezoelectric toner level sensor which serves to notify the operator that a particular toner hopper is running low on toner and needs to be refilled. Second, the toner cartridges and hopper lids are keyed to prevent the operator from inserting the wrong color of toner into the wrong hopper. Third, the hopper cover is interlocked so that it cannot be opened unless a toner cartridge is inserted and once it is opened, the toner cartridge cannot be removed until the cover is closed. Finally, once the toner hopper is closed, both the toner hopper and the toner cartridge are resealed so the toner cartridge can be removed.

Unfortunately, even with all of the checks that are provided, it is still possible for the operator to make a serious mistake when refilling the printer with toner. Nothing prevents the operator from trying to fill a full or partially full toner hopper. This mistake is especially likely on a color laser printer. For instance, an operator seeing the magenta toner empty light on the display panel might not pay attention to the particular color, might simply grab the wrong color, or may even assume that because the magenta toner is empty, so too must be the black, cyan and yellow hoppers. In any event, the toner in the cartridge cannot completely empty into the hopper so the hopper cover cannot be shut and the cartridge cannot be removed. As a result, the mixing paddle inside the hopper can become jammed which will in turn result in the toner hopper gear drive failing when the printer is operated. In any case, a service call is required to fix the device.

DISCLOSURE OF THE INVENTION

This invention provides a way to prevent an operator from attempting to add toner to a toner hopper which isn't yet empty or doesn't at least have enough room to accommodate the entire contents of a toner cartridge. While this description specifically refers to a color laser printer, the principals of this invention are universal in nature and may apply to virtually all dry toner electrographic systems, both monochromatic, as well as color.

Dry toner color copiers and laser printers use a four hopper toner supply assembly having a yellow toner hopper, a magenta toner hopper, a cyan toner hopper and a black toner hopper. Each hopper is equipped with a piezoelectric transducer which is configured to sense an empty condition inside the toner hopper. When the toner hopper is empty, the piezoelectric sensor signals the engine controller, which in turn displays a message on the front panel of the printer to notify the operator of the empty condition.

A selector shaft, which has a plurality of cams, one for each toner hopper, axially fixed on it, is positioned beneath the toner hopper assembly and is used to selectively engage and disengage the toner hopper lockout mechanism. The cams are positioned on the selector shaft so that each one interferes with the lower extremity of one of four cam follower members. Each of the cam follower members is slidably attached to a support plate which is fixed on the front side of the toner supply assembly. Each cam follower member further has a follower tip extending from its upper end and a follower pin extending generally perpendicularly from its midsection. The follower tip is positioned to engage the under side of a lockout member. There is one lockout member per toner hopper. Each of the lockout members are pivotally attached to pivot between a locked out position which has the lockout member in a generally upright position and a refill position which has the lockout member in a reclined position where it is out of the way of the toner hopper and corresponding toner cartridge.

Each of the follower pins on the individual cam follower members are engaged in inclined notches in a slider member which spans across the four cam follower members. Sideways motion of the slider member will either lock all four cam follower members in their upward locked position, or will allow the cam follower members to fall and rest against the cams. The slider member is controlled by a double action solenoid.

The lockout members have a claw-shaped configuration and when they are in their locked out position, fingers of the claw will interfere with the connection between a toner cartridge and that particular toner hopper. This interference will prevent the toner cartridge from being snapped on to the locked out toner hopper. However, when the slider member is slid by the solenoid into its refill position, the cam follower member corresponding to the empty toner hopper will be pushed down to its refill position by a torsion spring acting on the lockout member, allowing the lockout member to pivot away from the top of the toner hopper. In this position the toner cartridge can be engaged with the key system located along the back edge of the toner hopper lid. Once engaged with the key system, the toner cartridge base is then snapped down and held in place by a resilient latch. The base of the toner cartridge also engages a toner hopper interlock latch which allows the cover to be opened only when a cartridge is installed. As soon as toner enters the hopper from the cartridge, the piezoelectric transducer senses this and the engine controller activates the lockout device and moves the cam follower member to its locked out position. Once the cartridge is removed, the lockout member will pivot back to its locked out position which cannot be defeated by the operator.

DETAILED DESCRIPTION OF THE INVENTION

Figure 1:
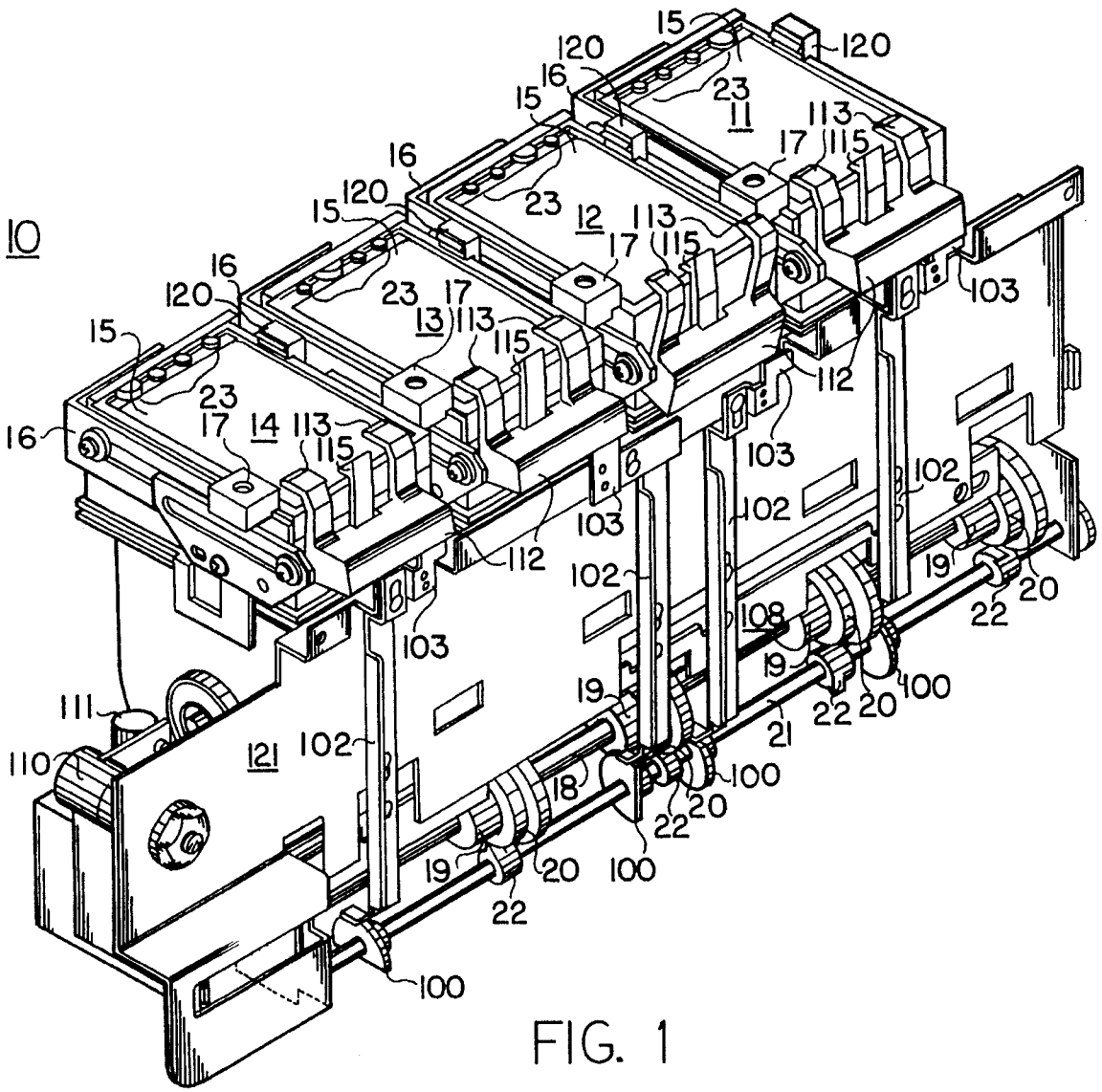
FIG. 1 is an isometric view of a four hopper toner supply assembly having the toner hopper lockout mechanism installed thereon.
Figure 2A:
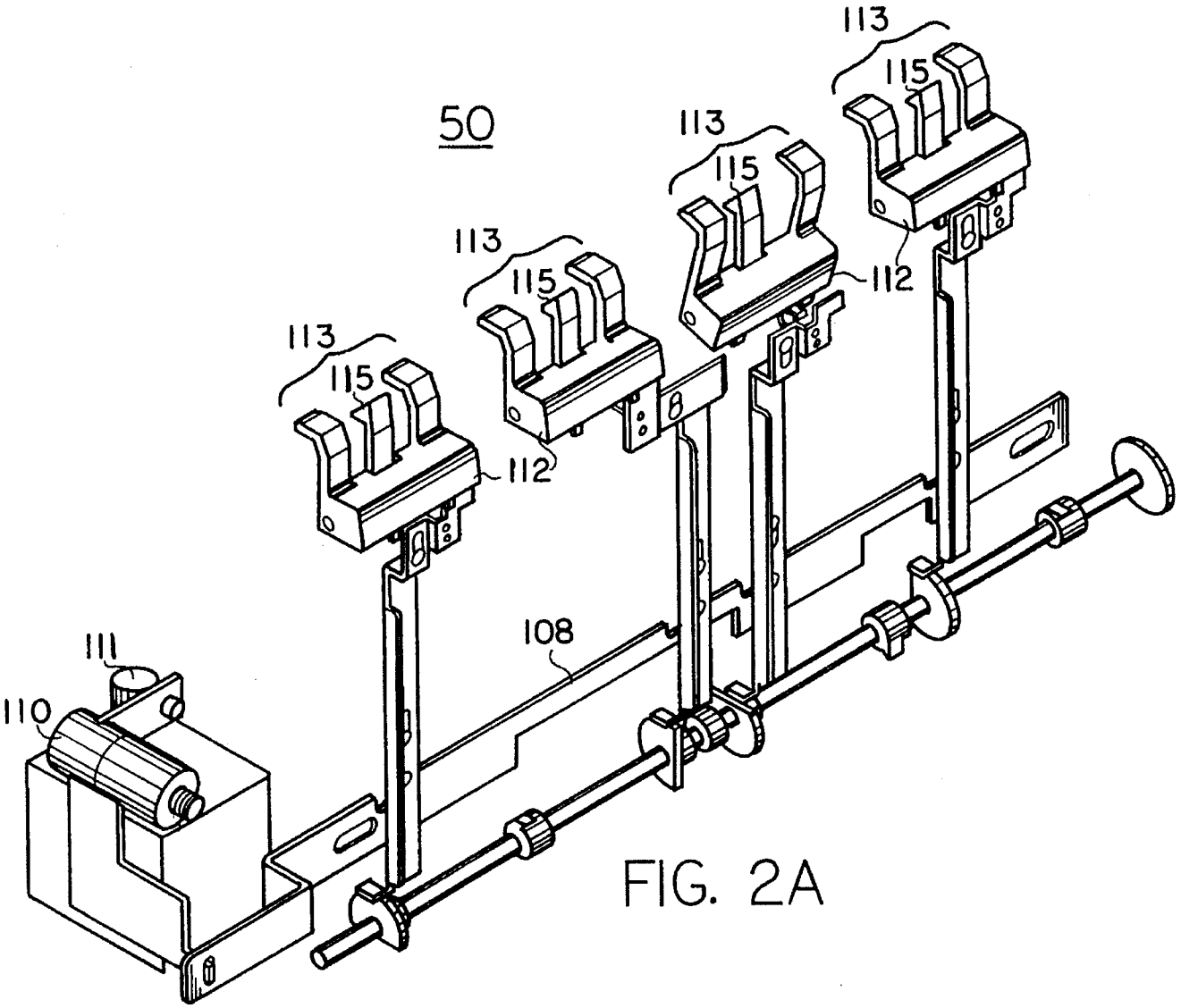
FIG. 2A is an isometric view of the toner hopper lockout mechanism showing the refill position for the magenta hopper.
Figure 2B:
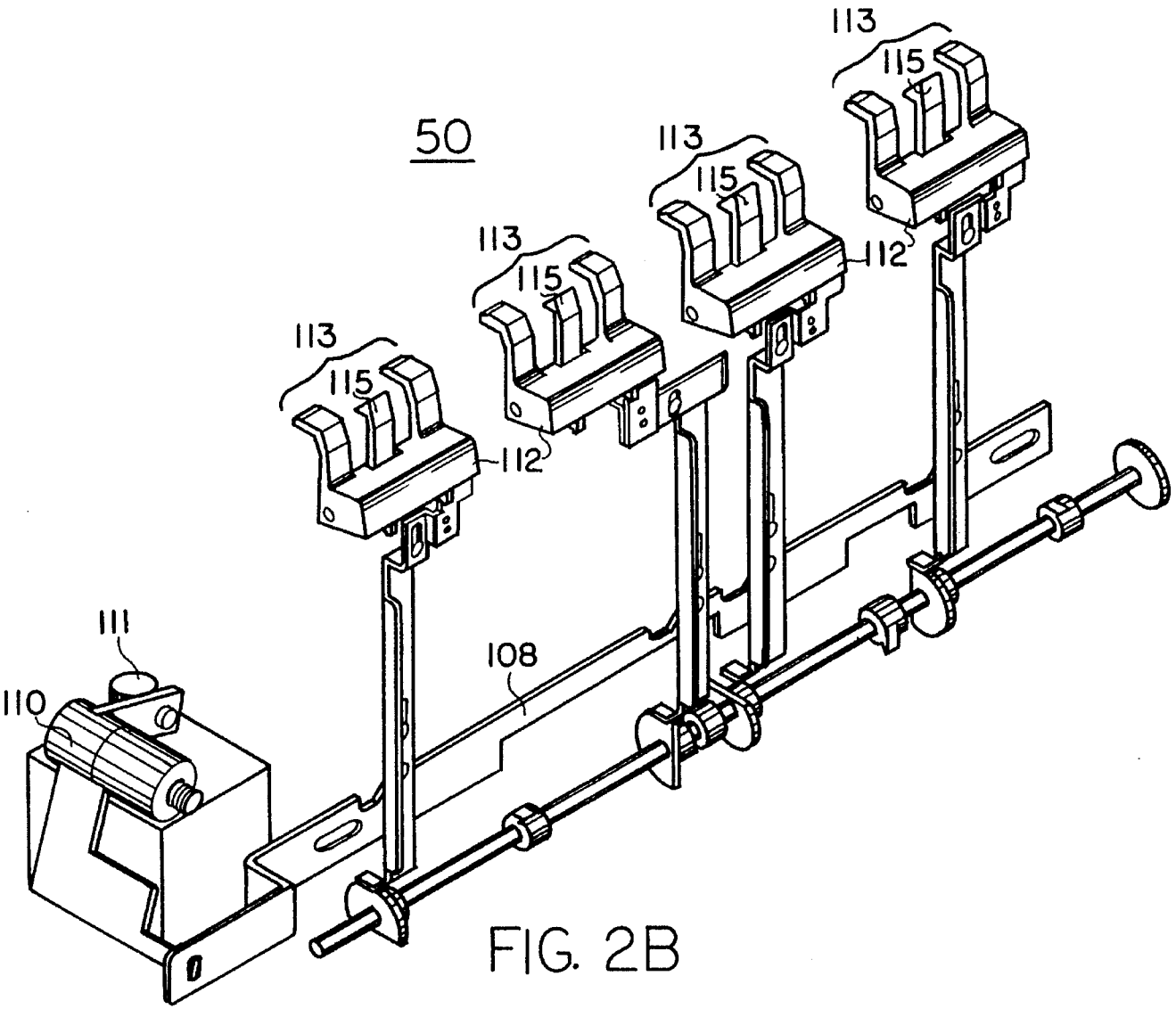
FIG. 2B is an isometric view of the toner hopper lockout mechanism showing the locked out position for all of the toner hoppers.

Referring now to the figures, a color electrographic printing toner supply assembly 10 is illustrated which includes the invention, here designated as toner hopper lockout mechanism 50. Toner supply assembly 10 includes four toner hoppers, yellow toner hopper 11, magenta toner hopper 12, cyan toner hopper 13 and black toner hopper 14. Each toner hopper is fitted with a cover 15 which prevents toner from spilling out of the hoppers and prevents objects from entering the hoppers. Each cover 15 is attached to its respective hopper by a cover slider 16, which is provided with a cover slider knob 17 to allow an operator to open and close covers 15 for refilling. Color electrographic printing toner supply assembly 10 is supported within the housing of a color image forming apparatus 25, which includes a dry toner developing means 26, usually employing a separate developer for each toner color, and an image retainer 27, such as a photoconducting drum.

A drive shaft 18 is suspended below the toner hoppers and serves as a mechanism to transfer rotational power to the supply augers and mixing paddles, neither of which are shown but are located within each toner hopper. Each toner hopper has a corresponding clutch 19 and set of drive gears 20 located on drive shaft 18. Clutches 19 are independently activated by corresponding clutch tabs 22, located on a separate selector shaft 21. Selector shaft 21 is suspended in parallel spaced relation to drive shaft 18. Selector shaft 21 is used by the engine controller to activate the supply augers and mixing paddles within the individual toner hoppers. Clutch tabs 22 are mounted in angular spaced relation to one another at progressive 90° increments. They are positioned to engage each toner hopper clutch 19, one at a time, in the order yellow, magenta, cyan, and black. When one of the clutches is engaged, the corresponding drive gear will turn and drive the supply auger and a hopper shaft, not shown. The hopper shaft turns stirring paddles inside the selected hopper body. Selector shaft 21 has a home position at which none of toner hopper clutches 19 are engaged. From this position, a rotation of 45° counterclockwise engages the yellow clutch, with subsequent rotations of 90° to engage the magenta clutch, the cyan clutch and the black clutch, and finally 45°0 to return to the home position.

Figure 3B:
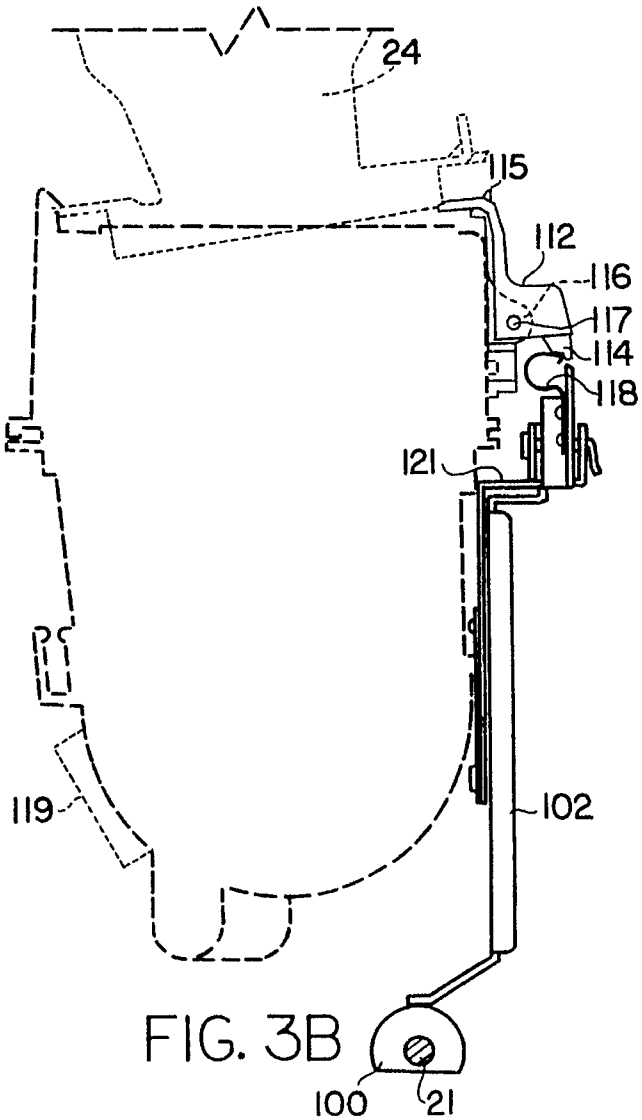
FIG. 3B is a side view of one of the toner hoppers in the locked out position.
Figure 3A:
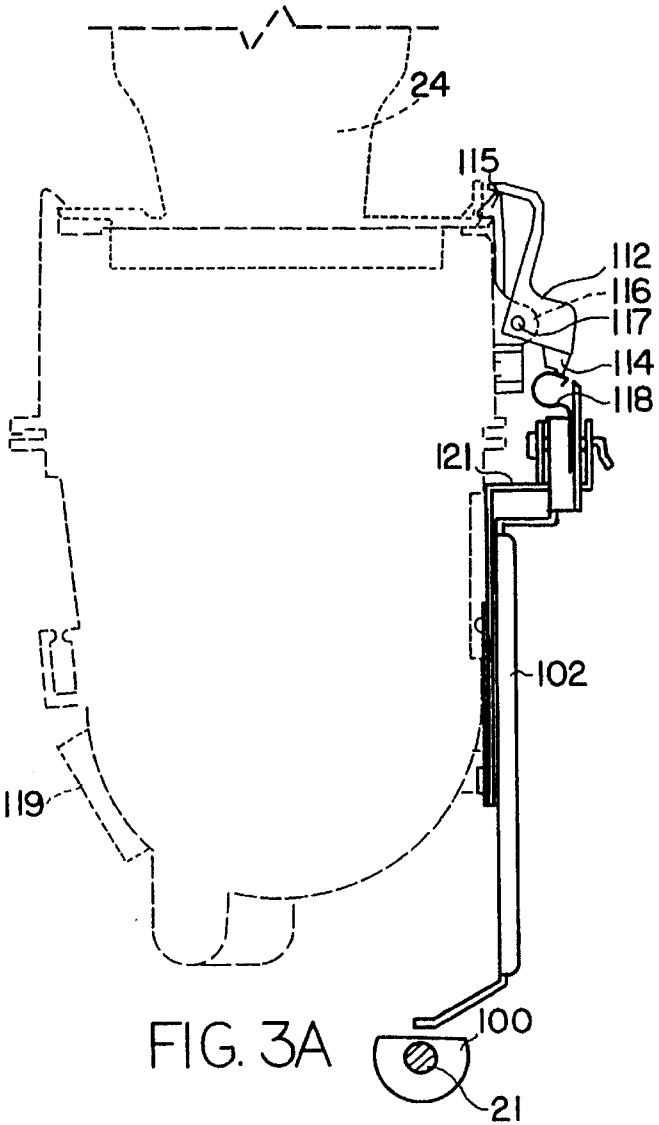
FIG. 3A is a side view of one of the toner hoppers being refilled with the cam follower member and the lockout member in their refill positions.
Figure 3D:
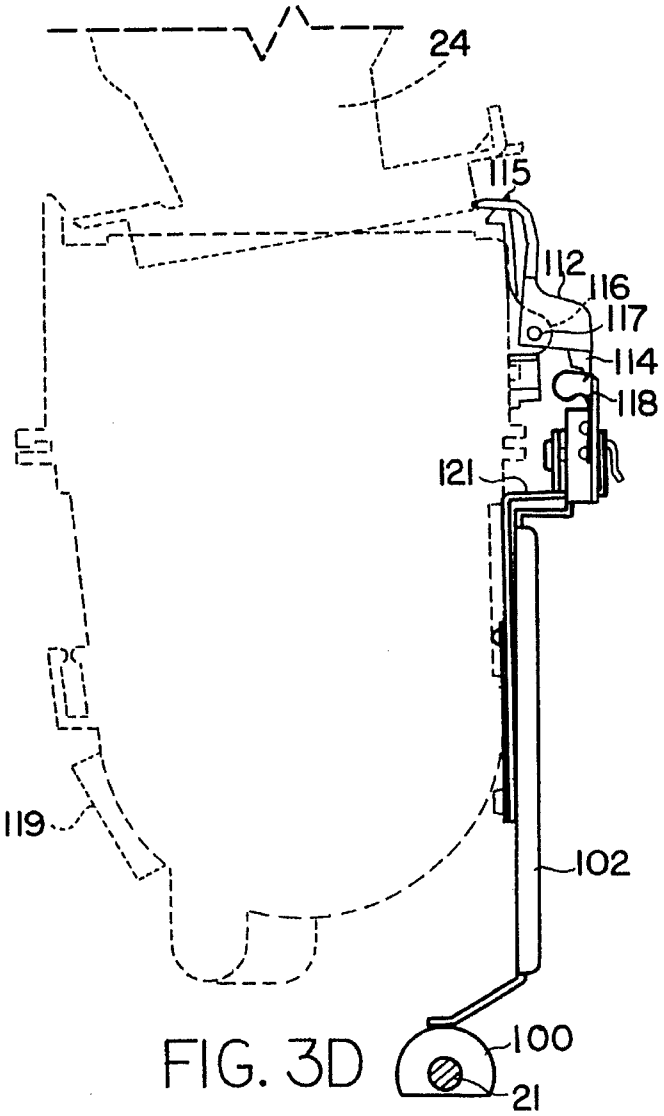
FIG. 3D is a side view of one of the toner hoppers being refilled with the cam follower member in the locked out position and the toner cartridge partially removed.

Toner hopper lockout mechanism 50 takes advantage of selector shaft 21, by using it to selectively lock out and unlock the individual toner hoppers. Selector shaft 21 has a plurality of cams 100, one for each toner hopper, axially fixed on it to thereby define a selector assembly to selectively engage and disengage the lockout assembly. Cams 100 are positioned on selector shaft 21 so that each one interferes with the lower extremity of a cam follower member 102. There is one cam follower member 102 for each toner hopper. Each cam follower member 102 is slidably attached to a support plate 121 which is fixed on the front side of toner supply assembly 10. Cam follower members 102 are slidable up and down between an upward lockout position and a downward refill position. This is accomplished using a pair of oblong or oval shaped openings 104 in each cam follower member 102, a spring bushing and pin assembly 122 and a stationary pin and bushing 123. A stationary pin 127 and bushing 125 act to slidably secure each cam follower member 102 to support plate 121 by engaging the lower oval opening 104 of each cam follower member 102. Stationary pin 127 and bushing 125 are also configured to allow a small angular displacement of each follower member 102, as is shown in FIGS. 3D. The upper oval opening 104 receives spring bushing assembly 122. Here, spring 107 and washer 128 are positioned about stationary pin 124 and bushing 106, between cam follower member 102 and the flange around the head of stationary pin 124. Stationary pin 124 is fixed to support plate 121. This configuration allows a lateral angular displacement of cam follower members 102, explained more thoroughly below.

Each cam follower member 102 also has a follower tip 103 extending from its upper end and a slider follower pin 105 extending generally perpendicularly from its lower midsection. Follower tips 103 are positioned to engage the under side of their corresponding lockout members 112, which are also described below.

Each slider follower pin 105 on the individual cam follower members 102 is engaged in an inclined follower notch 109 in slider member 108. Slider member 108 spans across all four cam follower members 102. Sideways motion of slider member 108 will either lock all four cam follower members 102 in their upward locked position, or will allow follower members 102 to be pushed down to rest on cams 100. A torsion spring about the pivot attachments point between each lockout member 112 and the individual toner hoppers acts to push cam follower members down when slider member 108 is in the unlocked position.

Figure 4A:
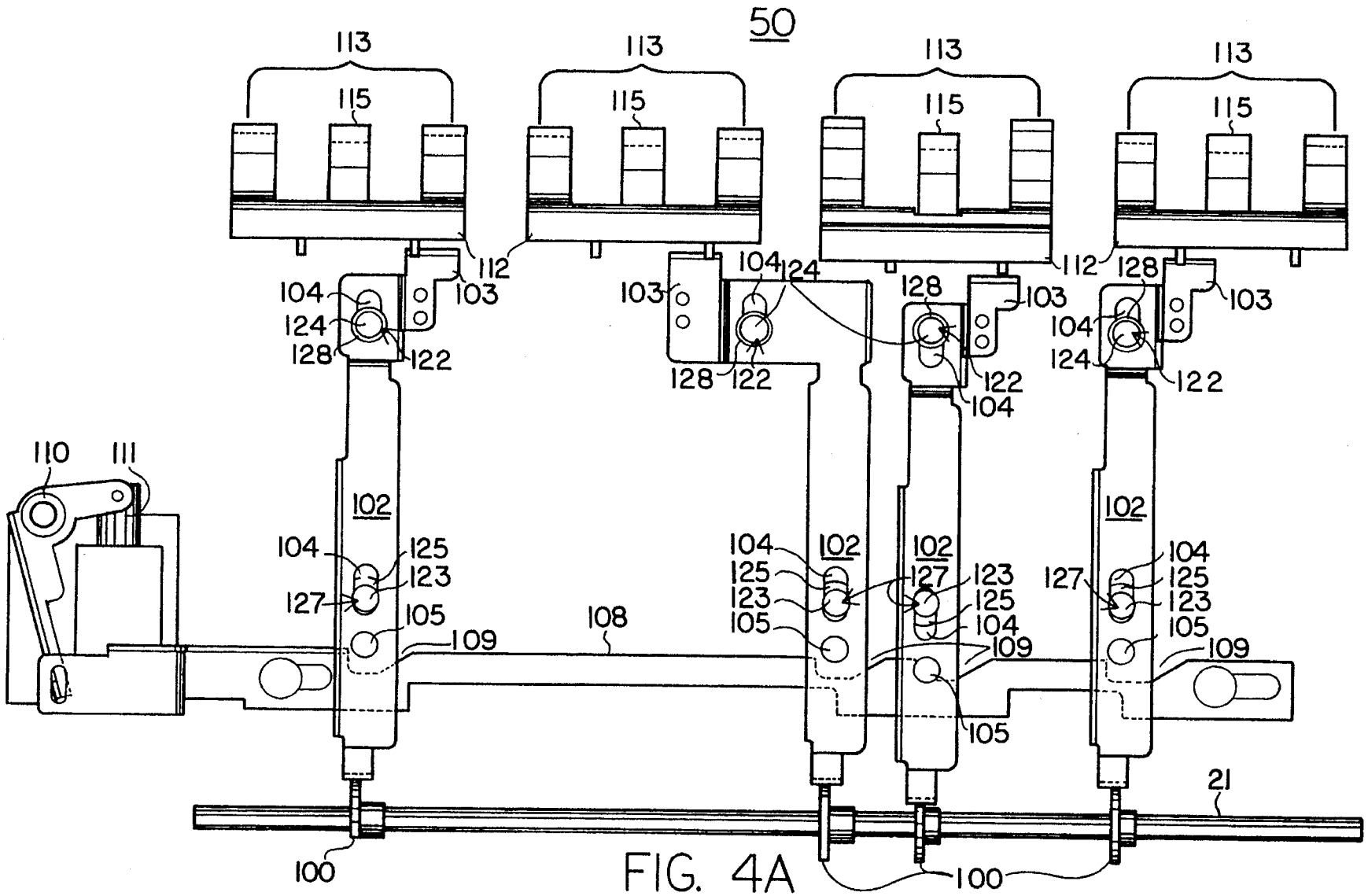
FIG. 4A is a front view of the toner hopper lockout mechanism showing the refill position for the magenta hopper.
Figure 4B:
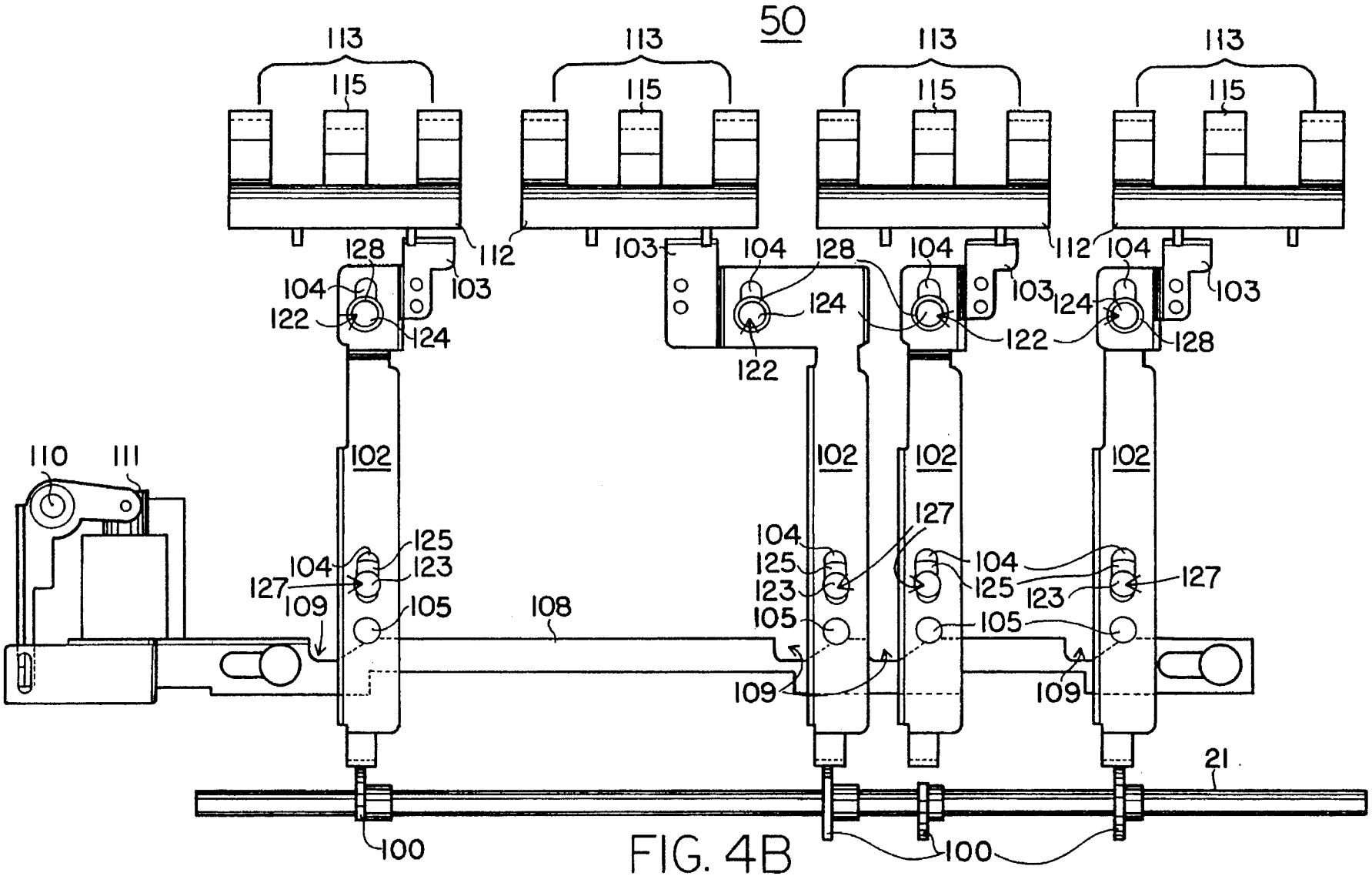
FIG. 4B is a front view of the toner hopper cover interlock mechanism showing the locked out position for all of the toner hoppers.

Slider member 108 is controlled by a double action solenoid 111. An upwards motion of solenoid 111 will move slider member 108 from left to right, as is shown in FIG. 4A, while a downward motion of solenoid 111 will move slider member 108 from right to left, as is shown in FIG. 4B. The transfer of motion from the up and down motion of the solenoid to the sideways motion of the slider member is accomplished by idler arm 110. Idler arm 110 pivots about a stationary point on support plate 121.

Figure 5A:
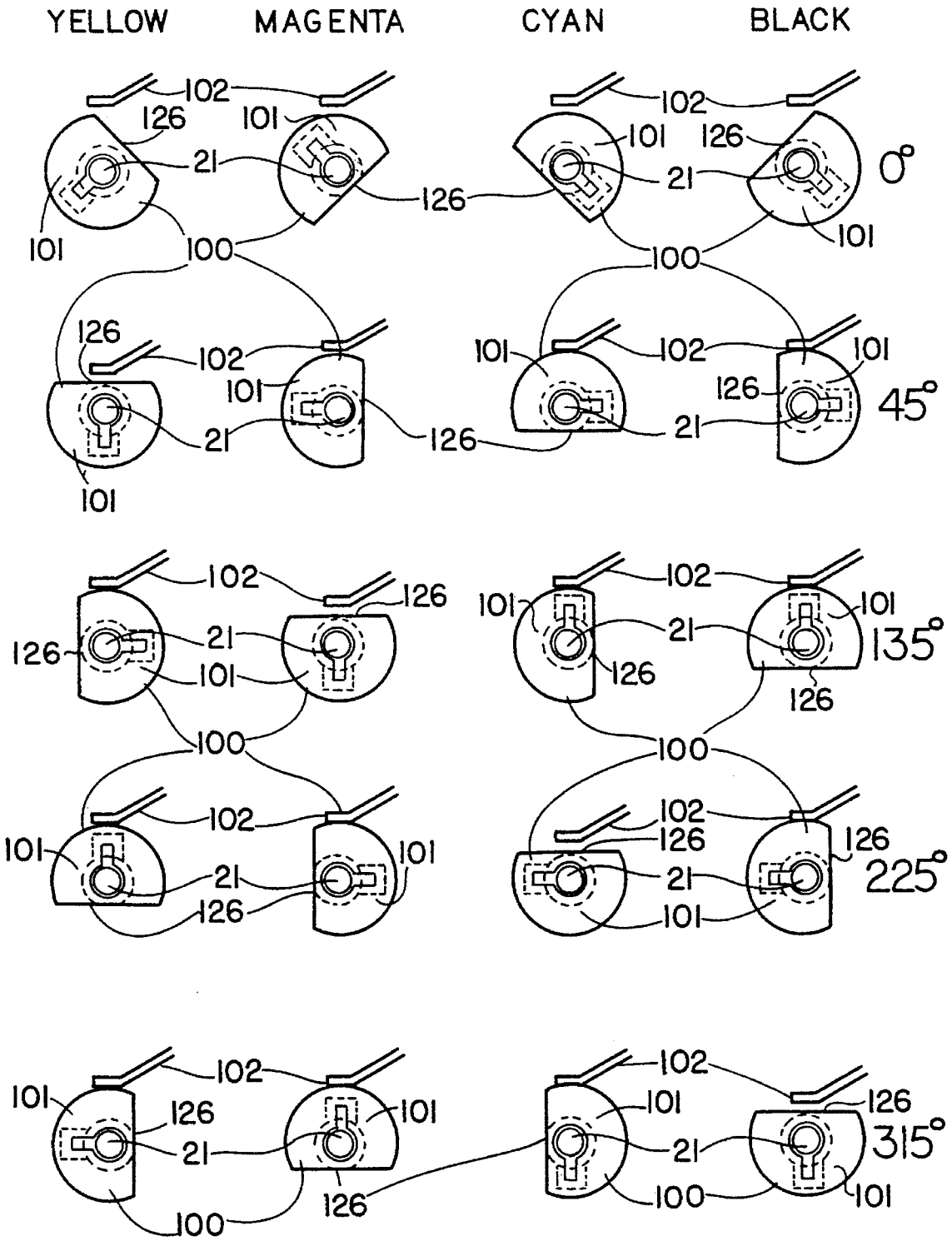
FIG. 5A is a schematic representation of a first configuration of the selecting cams and their relationship to one another.
Figure 5B:
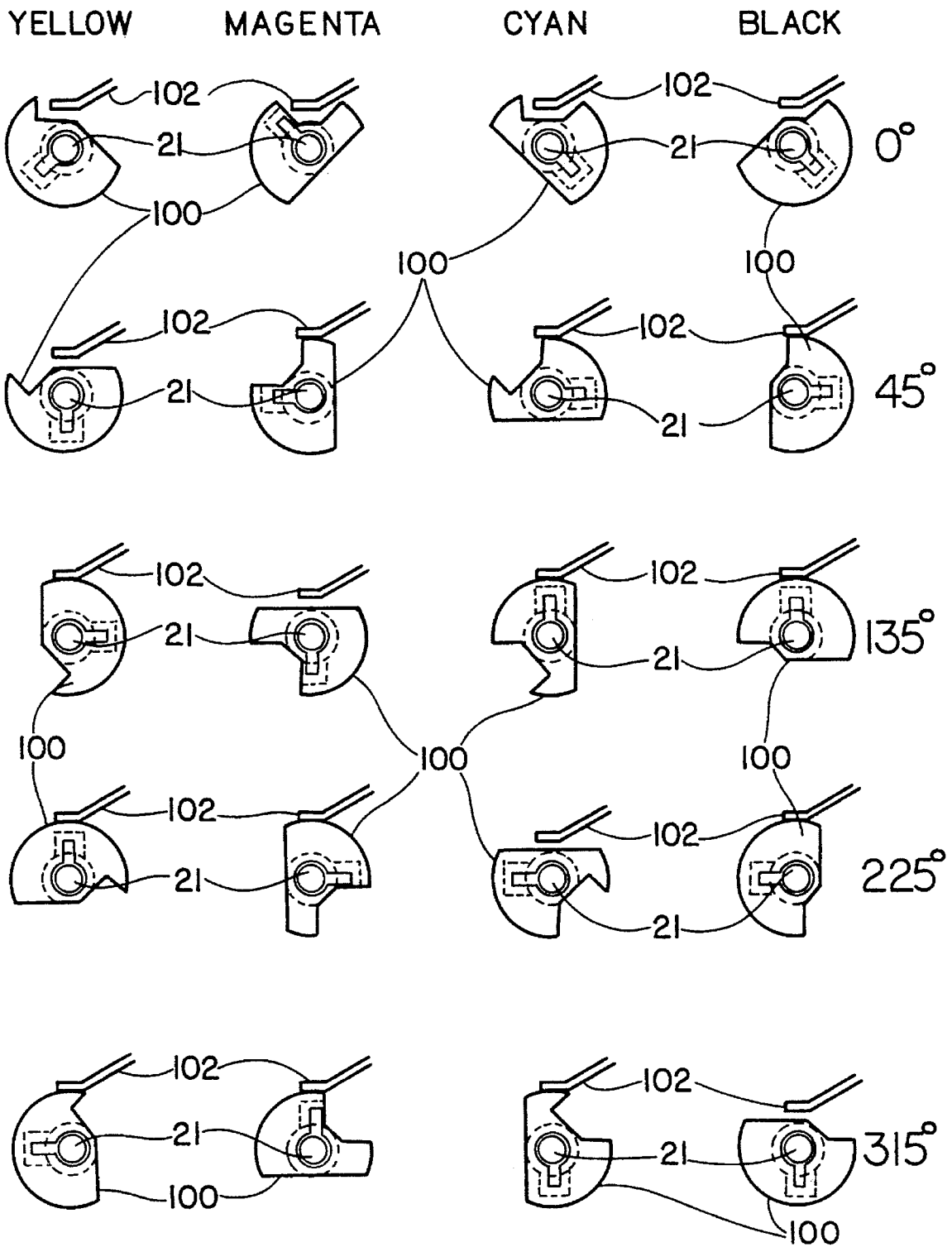
FIG. 5B is a schematic representation of a second configuration of the selecting cams and their relationship to one another.
Figure 6:
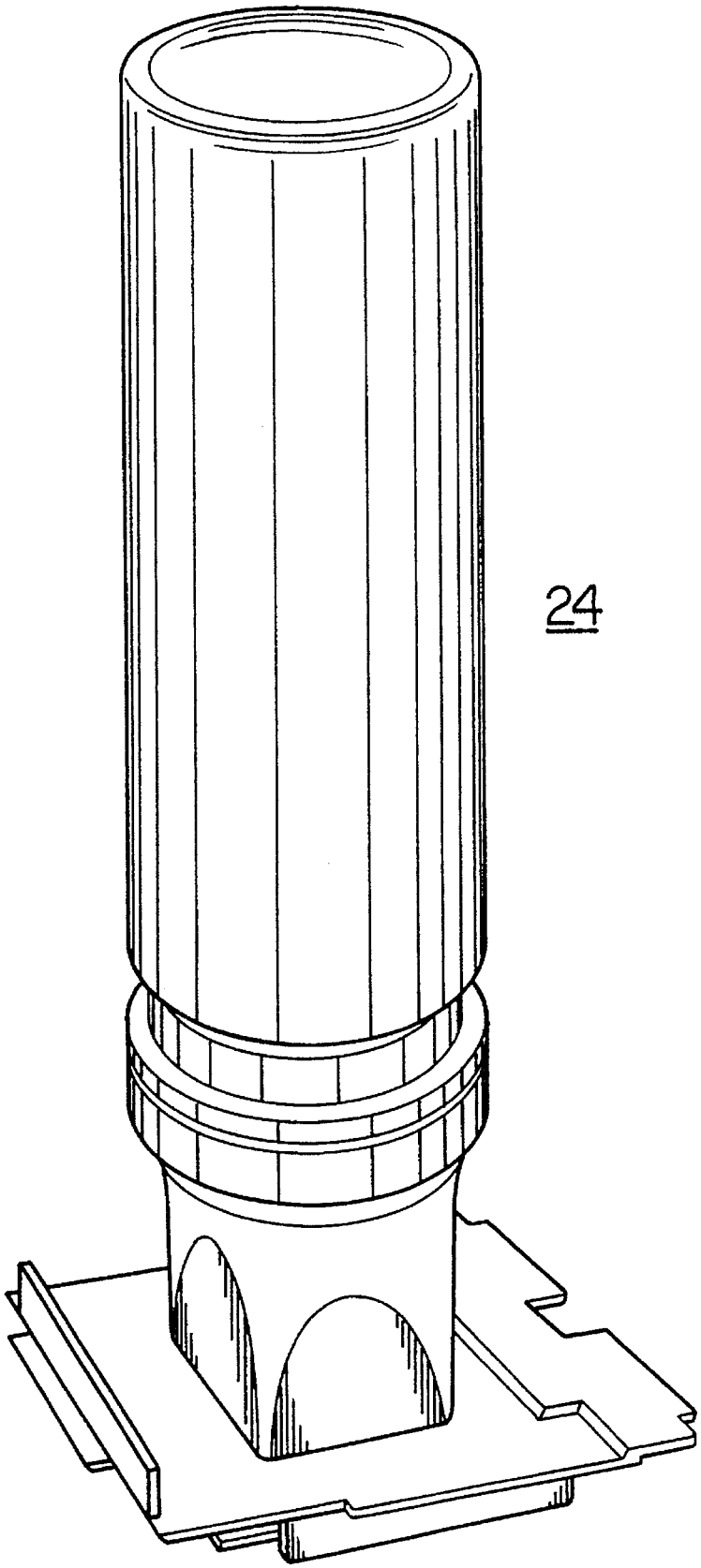
FIG. 6 is an isometric view of a toner cartridge showing the details of the toner cartridge base.
Figure 7:
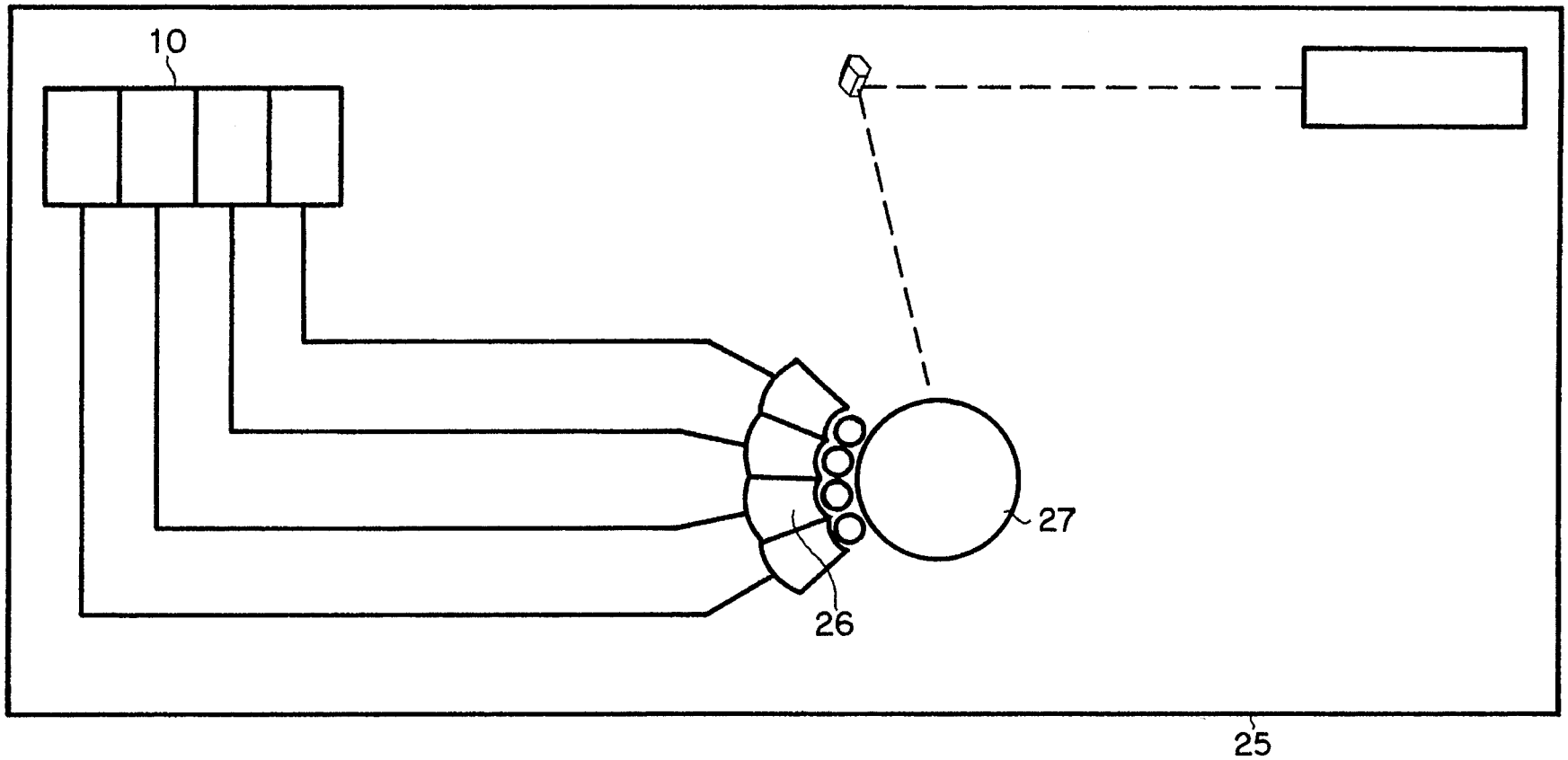
FIG. 7 is a schematic representation of a color image forming device employing the invention.

The lowest extremity of each follower member 102 is configured to ride on cams 100. Selector shaft 21 is only rotated when slider member 108 is in the locked out position as cams 100 are not intended to provide lifting force. Each cam 100 has a lobe portion 101, which will result in that particular toner hopper being locked out, and a flat portion 126, which will result in that particular toner hopper being unlocked so a toner cartridge 24 can be attached to the top of the toner hopper. A second embodiment of the cam configuration is illustrated in FIG. 5B. The first row of cams 100 across the top of that Figure illustrates a position of the selector shaft in which all toner hoppers are in their refill states. This allows for convenient filling of all the toner hoppers immediately after purchase by the consumer.

There is one lockout member 112 per toner hopper. Each lockout member 112 is pivotally attached to its individual hopper to pivot between a locked out position which has lockout members 112 in a generally upright position, and a refill position which has lockout members 112 in a reclined position out of the way of the toner hopper and corresponding toner cartridge 24.

Lockout members 112 have a claw-shaped configuration and when they are positioned in their locked out positions, fingers 113 of each member 112 will interfere with a connection between toner bottle or cartridge 24 and the particular toner hopper. This interference will prevent toner cartridge 24 from being snapped on to the locked out toner hopper. However, when slider member 108 is slid by solenoid 111 into its refill position, the cam follower member corresponding to the empty toner hopper will be pushed down to its refill position, allowing lockout member 112 to pivot away from the top of the toner hopper. In this position toner cartridge 24 can be engaged with key system 23, located along the back edge of each toner hopper lid. Once engaged with key system 23, the toner cartridge base is then snapped down and held in place by a resilient latch 115. The base of toner cartridge 24 also engages a toner cartridge interlock latch 120 which allows the cover to be opened only when a cartridge is installed.

Figure 3C:
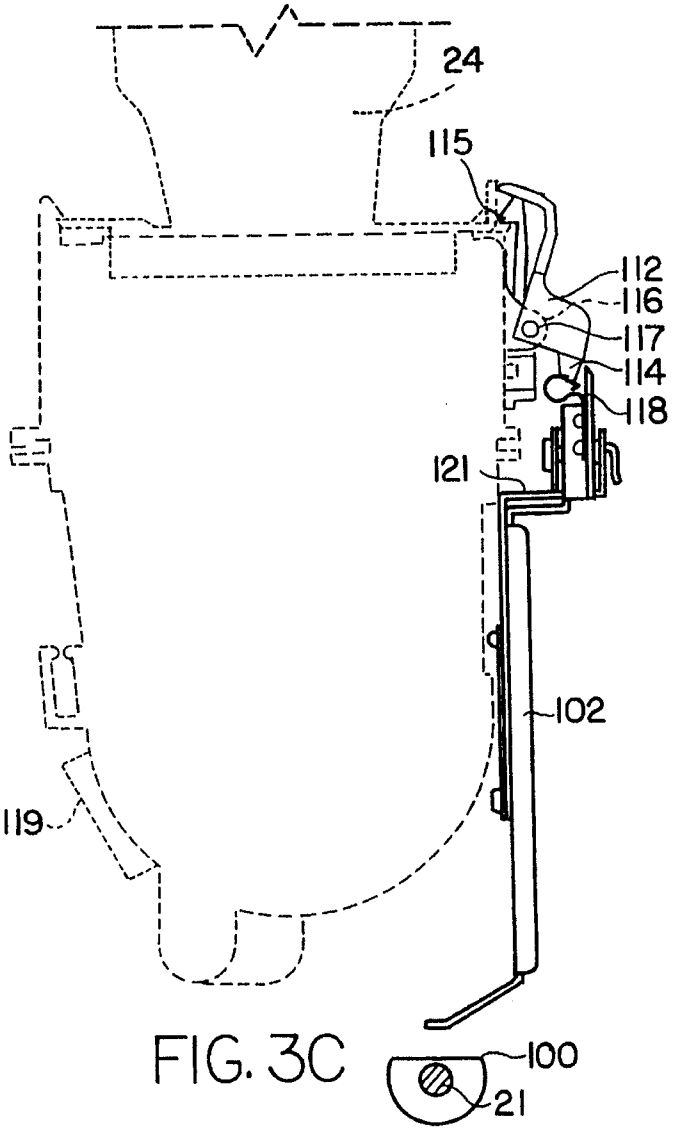
FIG. 3C is a side view of one of the toner hoppers being refilled with the cam follower member in the locked out position.
Figure 3E:
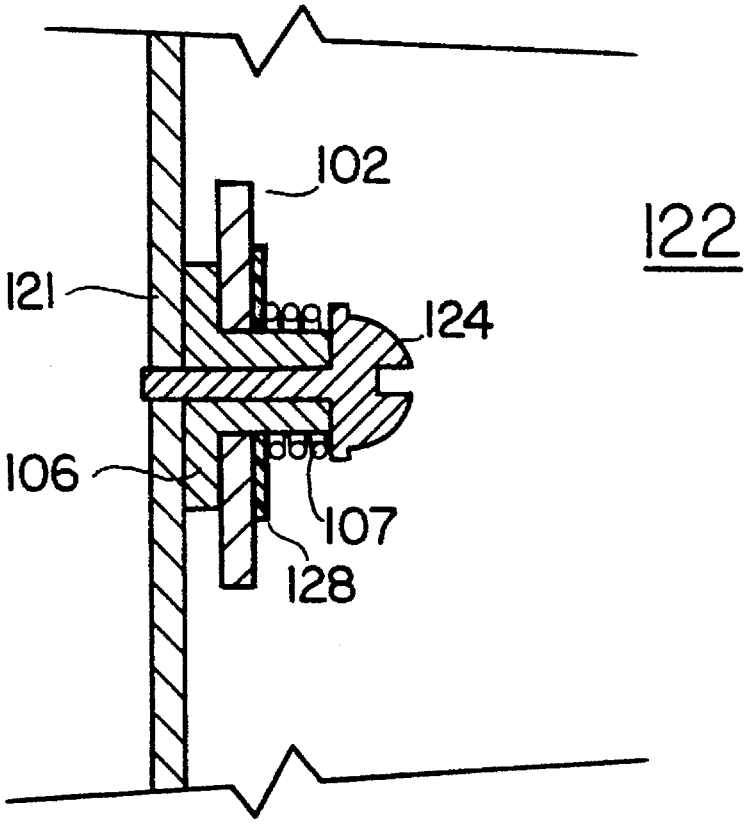
FIG. 3E is a detail view of the spring bushing assembly of one of the toner hoppers with the cam follower member in the locked out position and the toner cartridge partially removed.

Each hopper is equipped with a piezoelectric transducer 119 which is configured to sense an empty condition inside its respective toner hopper. When that particular toner hopper is empty, piezoelectric transducer 119 signals the engine controller, which in turn displays a message on the front panel of the device to notify the operator of the empty condition. Once the contents of a toner cartridge 24 have been emptied into the toner hopper, piezoelectric transducer 119 will sense the presence of toner and communicate this condition to the engine controller. The engine controller will then activate solenoid 111 causing cam follower members 102 to be slid upwards into their locked positions. However, the cam follower member which corresponds to the toner hopper which is being filled cannot force the lockout member into its locked out position due to interference by the base of toner cartridge 24 with lockout member 112. Instead, a "C" shaped leaf spring 118 will spring bias lockout member 112 toward its locked out position, as is shown in FIG. 3C. Once toner cartridge 24 is removed, lockout member 112 will pivot toward its locked out position until the stop tab 114 on that particular lockout member engages the inside surface of follower tip 103 on cam follower member 102. "C" shaped leaf spring 118 will continue to urge lockout member 112 towards its locked out position. This action will force the top portion of cam follower member 102 out away from support plate 121 by compressing spring 107 in spring bushing assembly 122. This will continue until the stop tab 114 is clear of follower tip 103 and lockout member 112 is in its locked out position. The interference between follower tip 103 and stop tab 114 will now prevent lockout member 112 from being manually pivoted to its unlock position, consequently preventing the operator from errantly installing a toner cartridge 24.

The sequence for adding toner is as follows. During normal operation, one of the toner hoppers will become empty. For this example, assume that magenta hopper 12 is empty. When this happens a message is displayed on the front panel to add magenta toner. As long as the printer is idle, none of toner hoppers can have a toner cartridge 24 connected because slider member 108 is in the locked position.

The operator indicates, by pressing a front panel key, that he or she wishes to add magenta toner to the system. The engine controller will first verify that magenta toner hopper 12 is empty. If it is, the controller will rotate selector shaft 21 to the magenta clutch engagement position, thus engaging both magenta clutch 19 and rotating magenta cam 100 to its refill position. The engine will not, however, engage drive shaft 18, so that engaging magenta clutch 19 has no effect. Since the lobe 101 of magenta cam 100 is not in a position to support cam follower member 102, cam follower member 102 will be pushed down, causing lockout member 112 to pivot into its refill position. Once lockout member 112 is in its refill position, the operator can snap toner cartridge 24 into position on toner hopper 12, engaging the base of the toner cartridge with cover interlock latch 120. The operator then is able to open cover 15, via cover slider knob 17, and drain toner cartridge 24. Immediately upon sensing that magenta toner hopper 12 has new toner, the engine controller will return slider member 108 to the locked out position forcing cam follower member 102 up so that lockout member 112 is spring biased against the base of toner cartridge 24. When the operator removes toner cartridge 24, lockout member 112 will pivot into its closed position.

While there is shown and described the present preferred embodiment of the invention, it is to be distinctly understood that this invention is not limited thereto but may be variously embodied to practice within the scope of the following claims.

What is claimed is:

1. A toner-hopper lockout mechanism for regulating the replenishment of toner in a hopper of an electrographic printing device which comprises:

toner level detector for detecting a low level of toner within the toner hopper:

toner cartridge lockout assembly being attached to the toner hopper, the toner cartridge lockout assembly including:

a lockout member being pivotally attached to the hopper and configured to pivot between a locked out position, at which the engagement of a toner cartridge with the toner hopper is prevented by a portion of the lockout member, and a refill position at which the engagement of a toner cartridge with the toner hopper is permitted;

a follower member having a follower tip being positioned to engage the lockout member; and a support plate being attached to the hopper and slidably supporting the follower member between an upward locked out position and a downward refill position; and spring bushing attachment means for slidably supporting an upper portion of the follower member but configured to permit the upper portion of the follower member to pull away from the support plate; and a selector assembly for selectively disengaging and reengaging the toner cartridge lockout assembly, being responsive to the toner level detector and configured to cause the lockout member to interfere with engagement of a toner cartridge with the toner hopper when a low level of toner is not detected in the toner hopper.

2. The toner hopper lockout mechanism of claim 1 wherein:

the lockout member includes a stop tab configured to interfere with the follower tip when both the follower member and the lockout member are positioned in their locked out positions to prevent the lockout member from moving into its refill position; and the stop tab being further configured to interfere with the upper portion of the follower member in its locked out position when the lockout member is pivoted from its refill position toward its locked out position and to push the upper portion of the follower member away from the support plate; and wherein the toner hopper lockout mechanism further comprises spring biasing means for urging the lockout member toward its locked out position when the follower member is in its locked out position.

3. A color image forming apparatus comprising:

an image retainer;

a plurality of developers;

a plurality of toner hoppers, each being attached to a different developer and each having toner level detector for detecting a low level of toner therein and toner cartridge lockout assembly being attached thereto, each toner cartridge lockout assembly including a lockout member being pivotally attached to the hopper and configured to pivot between a locked out position, at which the engagement of a toner cartridge with the toner hopper is prevented by a portion of the lockout member, and a refill position, at which the engagement of a toner cartridge with the toner hopper is permitted;

a plurality of follower members, each having a pin extending therefrom and a follower tip being positioned to engage the lockout member;

a selector assembly for selectively disengaging and reengaging each toner cartridge lockout assembly, being responsive to the toner level detectors and configured to prevent a toner cartridge to be engaged with a respective toner hopper when a low level of toner is not detected in said toner hopper:

a selector shaft;

a plurality of cams, each being affixed to the selector shaft and positioned to interfere with a lower extremity of a follower member;

a slider member having a plurality of follower pin notches therein for receiving the pin extending from a follower member; and a solenoid interacting with the slider member to slide the slider member between a locked position and a refill position.

4. The color image forming apparatus of claim 3 further comprising:

a support plate being attached to the hoppers and slidably supporting the follower members between an upward locked out position and a downward refill position; and a plurality of spring bushing attachment means, each slidably supporting an upper portion of a follower member but configured to permit the upper portion of a follower member to pull away from the support plate.

5. The color image forming apparatus of claim 4 wherein a lockout member includes a stop tab configured to interfere with a follower tip when both the follower member and the lockout member corresponding to the follower tip are positioned in their locked out positions to prevent the lockout member from moving into its refill position, the stop tab being further configured to interfere with the upper portion of the follower member in its locked out position when the lockout member is pivoted from its refill position toward its locked out position and to push the upper portion of the follower member away from the support plate, and the color image forming apparatus further comprises spring biasing means for urging the lockout member toward locked out position when the follower member is in its locked out position.

* * * * *